US006412383B1

(12) United States Patent
Henry et al.

(10) Patent No.: US 6,412,383 B1
(45) Date of Patent: Jul. 2, 2002

(54) DEVICE FOR CROSS CUTTING MATERIAL WEBS

(75) Inventors: Herve Henry, Creil; Philippe Robin, Cramoisy; Serge Lanvin, Cire les Mello, all of (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/207,474

(22) Filed: Dec. 8, 1998

(30) Foreign Application Priority Data

Dec. 8, 1997 (FR) ..... 9715478

(51) Int. Cl.[7] ..... B26D 1/12

(52) U.S. Cl. ..... 83/663; 83/658; 83/659; 83/347; 492/28; 492/48

(58) Field of Search ..... 83/663, 346, 347, 83/658, 659, 698.42; 492/28, 48

(56) References Cited

U.S. PATENT DOCUMENTS

| | | | | |
|---|---|---|---|---|
| 1,601,335 A | | 9/1926 | Addison | |
| 1,678,896 A | * | 7/1928 | Wood | 83/659 X |
| 2,768,690 A | | 10/1956 | Roberts et al. | |
| 2,986,058 A | | 5/1961 | Besserdich | |
| 3,252,640 A | | 5/1966 | Huck | |
| 3,832,926 A | * | 9/1974 | Leaseburge et al. | 83/346 X |
| 3,880,037 A | | 4/1975 | Duckett et al. | |
| 3,954,034 A | * | 5/1976 | Broderick | 83/346 X |
| 4,031,600 A | * | 6/1977 | Whigham | 83/347 X |
| 4,073,208 A | | 2/1978 | Kirkpatrick | |
| 5,078,535 A | * | 1/1992 | Kirkpatrick | 83/347 X |

FOREIGN PATENT DOCUMENTS

| | | |
|---|---|---|
| DE | 39 34 673 A1 | 4/1991 |
| EP | 0 108 356 A1 | 5/1984 |
| EP | 0 523 346 B1 | 1/1993 |
| EP | 0 553 679 A1 | 8/1993 |
| GB | 439039 | 11/1935 |
| JP | 2-137371 | 11/1990 |

* cited by examiner

*Primary Examiner*—M. Rachuba
(74) *Attorney, Agent, or Firm*—Laurence A. Greenberg; Werner H. Stemer; Gregory L. Mayback

(57) ABSTRACT

A device for cross cutting material webs includes a cutting-cylinder pair formed of mutually cooperating cylinders having respective cylinder cores and circumferential surfaces formed by exchangeable circumferential elements, the circumferential elements being arranged removably around the respective cylinder cores of the cylinders.

10 Claims, 2 Drawing Sheets

DEVICE FOR CROSS CUTTING MATERIAL WEBS

BACKGROUND OF THE INVENTION

Field of the Invention

The invention relates to a device for cross cutting material webs, in particular printed material webs after they have been printed in a rotary printing press.

The published German Patent Document DE 39 34 673 A1 concerns a cross cutting device for moving webs, wherein format length is adjustable. This is particularly suited for a folder disposed downline of a printing press. The cross cutting device is formed of two cylinders of like diameter arranged on opposite sides of the web, one of the cylinders, namely a knife cylinder, carrying at least one cutting knife borne by a cutting beam, and the other cylinder, namely an opposing or counter cylinder, carrying a corresponding number of flexible cutting bars, borne by bearing beams. To be able to cut different format lengths with a single pair of cylinders, the diameter of the knife cylinder is dimensioned so that, for the longest format, the circumferential cylinder speed is equal to or slightly greater (by about 3%) than the web speed, that furthermore each cutting beam and each bearing beam are mounted in the cylinders appertaining thereto so that they are swivellable about swivel axes parallel to the cylinder axes of rotation which lie within the axes of rotation, and that each cutting beam and each bearing beam is swivelled by a swivel mechanism during the cutting operation with adjustable travel (including zero travel for the longest format) periodically counter to the web running direction and subsequently back again into the starting position thereof, about the respective swivel axes thereof in the circumferential direction of the knife cylinder and the opposing cylinder, respectively.

The published European Patent Document EP 05 23 346 B1 concerns a device for transporting a paper web into a folder of a printing press. Applied to the cutting cylinders of a cutting-cylinder pair are material web-profiling strips, which superpose a profile reinforcing the web. The strips are adjoined by smoothening surfaces, which remove the web-reinforcing profile from the web again, the instant the leading end of the material web has entered the conveying device adjoining the pair of cutting cylinders. Smoothening surfaces and profiling strips are applied to the circumferential surfaces of the cylinders contacting the web, the cylinders themselves being formed as rotational bodies of solid material.

The Published Non-prosecuted Japanese Utility Model Application (JP Hei) 2 137 371 is concerned with a cutting device of a folder without puncture needles or pins. In a cutting device of a thus pinless folder, a folding roller having folding blades attached to the outer circumference thereof is freely rotatable. The knife-supporting roller is freely rotatable with respect to the folding roller. A narrow band of flexible material is arranged on the outer circumference of the folding roller and knife-supporting roller in the circumferential direction of the respective roller, alternating in the direction of the rotational axis of the respective rollers.

The published European Patent Document EP 0 523 435 B1 is concerned with a cross cutting device on folding units for web-fed rotary presses. This cross cutting device is formed of a cutting knife, which is rigid against bending and is arranged on a cutting cylinder, and a groove strip or reglet, which is arranged on a groove cylinder as an abutment for separating cut material. The groove reglet is formed of a unipartite groove member and a compression-spring member. Viewed in the direction of movement of the groove cylinder, initially the groove member and then the compression-spring member are arranged adjacent one another. The groove member of the groove reglet is formed of plastic material having low elasticity, whereas the compression spring member is formed of plastic material of higher elasticity compared with that of the groove member.

With regard to folders without pins or puncture needles, it has been known heretofore to cover the circumferential surfaces of the cutting cylinders with an elastic material, which may be adhesively bonded, for example, on the circumferential surfaces thereof. The elastic material has the effect of prestressing the material taken up during the cross cutting operation. The disadvantage of using such adhesively bonded elastic materials is that the surfaces thereof are worn out and abraded very quickly, and the downtime of a folder required for reconditioning the layers is very lengthy. The reconditioning of such elastic layers is also very time-consuming because it is usually very difficult to gain access to the cutting-cylinder pair in a folder.

SUMMARY OF THE INVENTION

In view of the hereinafore outlined disadvantages of the prior art, it is an object of the invention to provide a device for cross cutting material webs wherein the time period required for exchanging cylinder coverings is considerably reduced over the corresponding time period for the devices of the prior art, so that faster resumption of production can be ensured.

With the foregoing and other objects in view, there is provided, in accordance with one aspect of the invention, a device for cross cutting material webs, comprising a cutting-cylinder pair formed of mutually cooperating cylinders having respective cylinder cores and circumferential surfaces formed by exchangeable circumferential elements, the circumferential elements being arranged removably around the respective cylinder cores of the cylinders.

In accordance with another feature of the invention, the cylinder cores have lay surfaces and lay projections.

In accordance with a further feature of the invention, one of the cylinders is a knife cylinder, and the lay projections are arranged on the knife cylinder next to a knife mounting.

In accordance with an added feature of the invention, one of the cylinders is a groove cylinder, and the lay projections are arranged on the groove cylinder adjacent to a groove beam.

In accordance with an additional feature of the invention, the circumferential elements are formed of first circumferential elements and second circumferential elements, the first circumferential elements engaging around the second circumferential elements on the respective cylinder cores.

In accordance with yet another feature of the invention, the first and the second circumferential elements, respectively, are provided separately with a covering portion.

In accordance with yet a further feature of the invention, during assembly of the first and the second circumferential elements on the cylinder cores, respectively, a covering engageable over the first and the second circumferential elements, respectively, is clamped between the cylinder cores, respectively, and the first circumferential elements.

In accordance with yet an added feature of the invention, the first and the second circumferential elements are formed of elastically deformable material.

In accordance with yet an additional feature of the invention, the first and the second circumferential elements are formed of aluminum or an aluminum alloy.

In accordance with another aspect of the invention, there is provided a folder having a cutting-cylinder pair comprising a knife cylinder and a groove cylinder, having first and second circumferential surfaces, respectively, formed by exchangeable first and second circumferential elements arranged removably on the respective cylinder core of at least one of the knife cylinder and the groove cylinder.

In accordance with a concomitant feature of the invention, the folder is of the pinless type.

The advantages which this invention brings with it are of a diverse nature. The exchangeable circumferential elements can be removed simply and quickly from the cutting cylinder region on the folder, so that reconditioning of the covering does not have to be performed in the folder. Consequently, once the circumferential elements have been exchanged, the folder is again available for production. The worn-out circumferential surfaces of the exchangeable circumferential elements can be renewed again outside the folder, without therefore having to exchange the cutting-cylinder pair as a whole.

In a further refinement of the concept upon which the invention is based, the cylinder cores both of the knife cylinder and of the groove cylinder may be provided with lay surfaces and with lay projections in order to achieve easier centering of the circumferential elements. In this regard, the circumferential elements are arranged, in particular, symmetrically with respect to one another. The lay projections on the cylinders are arranged on the knife cylinder alongside the cutting knife mounting and are arranged on the groove cylinder alongside the groove beam. In an advantageous manner, the circumferential elements, which are received near the cutting knife mounting or near the groove beam, grasp the circumferential elements which are disposed opposite to the cutting tool mounting and opposite to the groove beam, respectively, at the ends thereof. In this manner, defined register surfaces and a smooth circumferential surface are attained on the cutting-cylinder pair.

The circumferential elements which are exchangeably fastened onto the cylinder cores may be both provided with portions of a covering, as well as, after mounting, wrapped in a continuous covering material. The ends of the continuous covering material may be clamped between the circumferential elements and the cylinder core and be subjected to tension in the circumferential direction.

The circumferential segments may either be produced entirely from an elastically deformable material or made from aluminum or an aluminum alloy.

The circumferential elements which are exchangeable according to the invention can be used both for cutting-cylinder pairs of folders, generally, or of folders which are pinless or without puncture needles.

Other features which are considered as characteristic for the invention are set forth in the appended claims.

Although the invention is illustrated and described herein as embodied in a device for cross cutting material webs, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
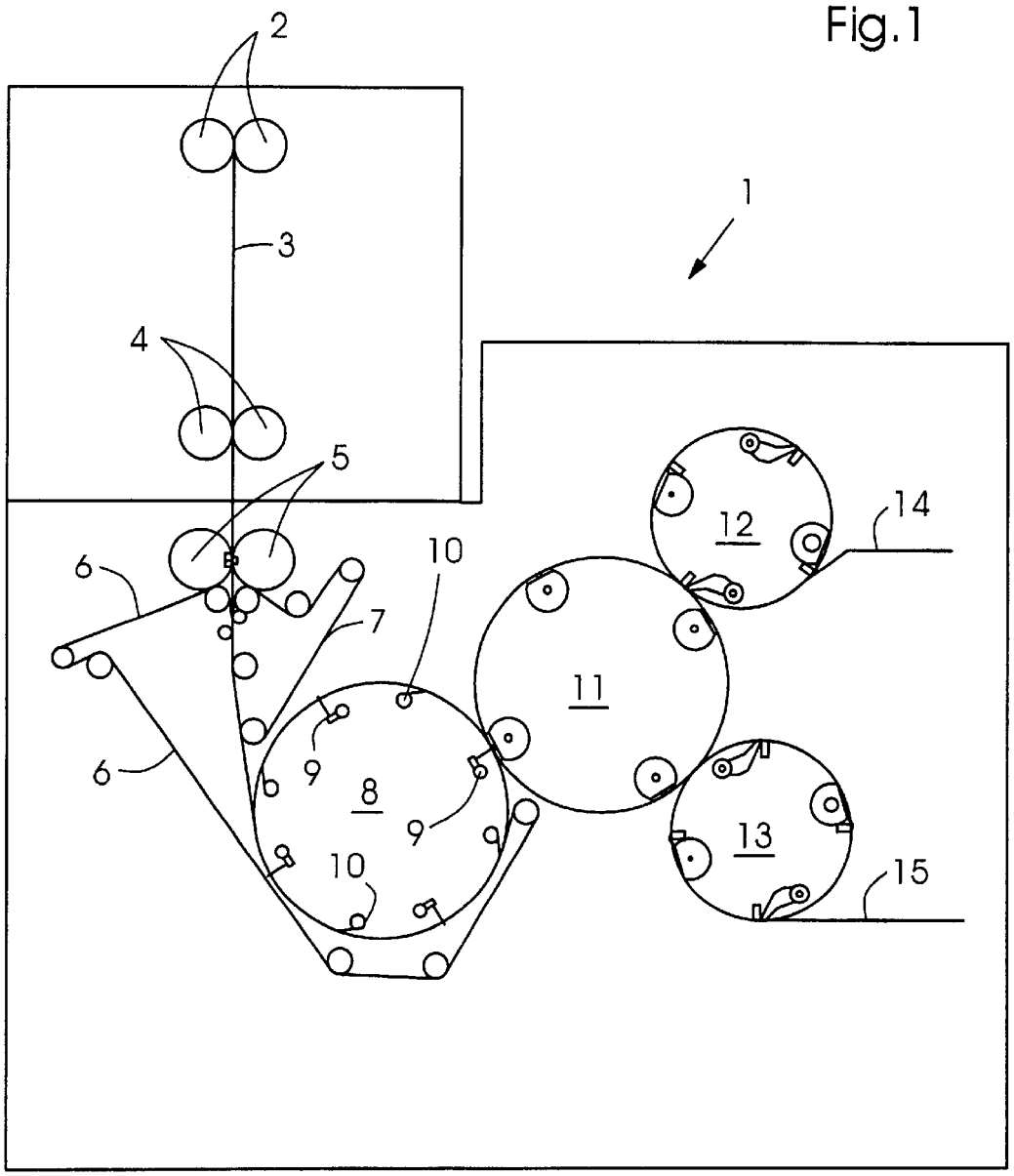
FIG. 1 is a diagrammatic side elevational view of a folder without puncture needles or pins, having transport surfaces arranged downline of a pair of cutting cylinders.

Referring now to the figures of the drawings and, first, particularly to FIG. 1 thereof, there is shown therein a material web 3, which has been printed on only one or both sides thereof in printing units not otherwise represented in greater detail herein, and is transported by first and second draw-roller pairs 2 and 4 into a folder 1. Arranged downline of the second draw-roller pair 4 is a cutting-cylinder pair 5 formed of a knife cylinder and a groove cylinder. In a nip of the cutting-cylinder pair 5, individual copies are cut off from a leading end of the infed material web 3 by a cross cutting operation. The copies are taken up by transport or conveyor belts or tapes 6 and 7 disposed downline of the cutting-cylinder pair 5, and conveyed further on. The transport belts 6 and 7 travel around deflecting rollers and are provided with tensioning devices; the belts 6 and 7 convey the individual copies to a folding blade cylinder 8, around the circumference of which, a first belt 6 of the transport belts 6 and 7 is partly wrapped.

The folding blade cylinder 8 is provided, at the circumference thereof, both with grippers 10 and with folding blades 9, more particularly four folding blades 9 and four gripper bars 10 in the illustrated embodiment, the blades 9 and the gripper bars 10 being offset 90° from one another around the circumference. Due to the fact that the grippers 10 are open at the time of copy transfer, the copies are taken over by the first transport belt 6 and, the instant that a folding blade 9 lies opposite a folding jaw of a jaw cylinder 11, the back or spine of the copy is pushed into the jaw. After one or more cross foldings have taken place in such a manner, the cross-folded copies are accepted by an upper or lower transporting cylinder 12, 13 and fed to respective deliveries 14 and 15 for further processing.

Figure 2:
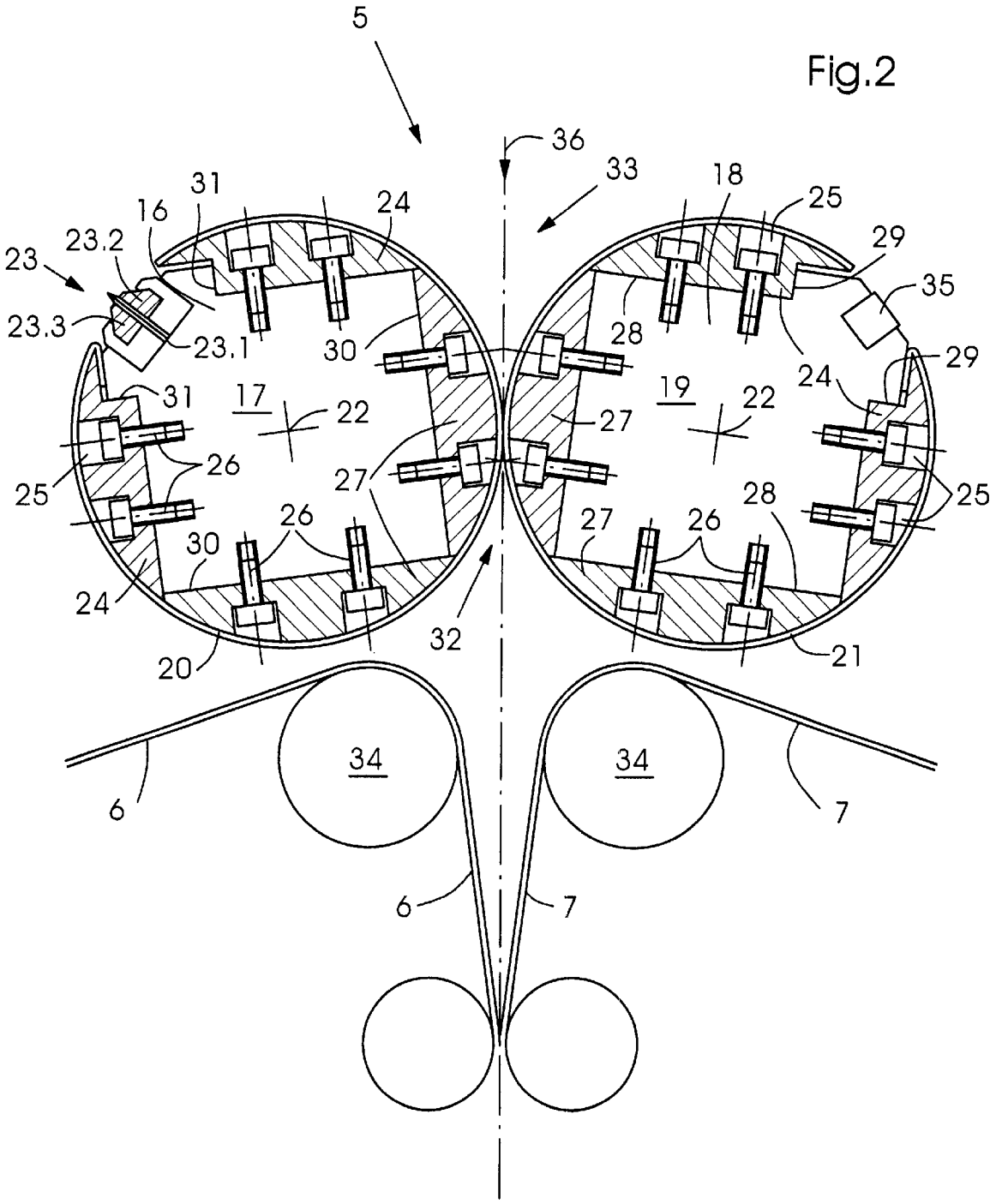
FIG. 2 is an enlarged fragmentary view, partly in section, of FIG. 1, showing the cylinder cores of the cutting-cylinder pair, which are complemented with circumferential elements on the circumference thereof and have either a cutting knife mounting support or a groove beam.

In FIG. 2, the cutting-cylinder pair 5 of a pinless folder, i.e., a folder without puncture needles, is reproduced in an enlarged side elevational view of FIG. 1.

The cutting-cylinder pair 5 is formed of a knife cylinder 16 and a groove cylinder 18. In contrast with conventionally produced cutting cylinders, in the case of the cutting-cylinder pair 5 according to the invention of the instant application, respective cylinder cores 17 and 19 which are of substantially rectangular construction, are provided with circumferential elements 24 and 27, respectively. The circumferential elements 24 and 27 have bores 25 formed therein, through which screws 26 or the like extend by which the circumferential elements 24 and 27 are fastenable to the circumference of the respective cylinder cores 17 and 19. The individual circumferential elements 24 and 27, respectively, are generally provided with covering portions 20 and 21, respectively, which take up the respective preceding, leading end of the material web before the cross cutting operation commences. As an alternative to fastening the covering on the circumferential elements 24 and 27, it would be conceivable for a continuous covering 20, 21 to be wrapped around the circumferential elements 24 and 27, respectively, and clamped between the respective circumferential element 24, 27 and the corresponding cylinder core 17, 19.

The cylinder cores 17 and 19, respectively, which accept the circumferential elements 24 and 27, respectively, rotate about the respective axes of rotation 22 thereof. Provided on the respective cylinder cores 17 and 19 are a cutting knife mounting 23 and a groove beam 35, respectively. The cutting knife mounting 23 is formed of a first and a second clamping jaw 23.2 and 23.3, respectively, between which the cutting knife 23.1 is received. A groove beam 35, which is formed of hard rubber or similar material and cooperates with the cutting knife 23.1, is set into the groove cylinder 18 of the cutting-cylinder pair 5. To simplify and speed up the assembly, the individual circumferential elements 24 and 27, respectively, may be screwed or threadedly secured together with the cylinder cores 17 and 19, respectively.

In the region of the cutting knife mounting 23 and the groove beam 35, the cylinder cores 17 and 19 have lay projections 29 and 31. In addition to the latter, the cylinder cores 17 and 19 are provided with lay surfaces 28. The fact that lay projections 29 and 31 and lay surfaces 28 and 30 are provided on both cylinders 16 and 18, respectively, allows the circumferential elements 24 to be positioned extremely accurately, because two lay surfaces are available. By exact alignment of the circumferential elements 24 on the circumference of the cylinder cores 17 and 19, precise register surfaces are created for the circumferential elements 27, because the end regions of the circumferential elements 24 engage over the ends of the circumferential elements 27. This applies both to the knife cylinder 16 and to the groove cylinder 18 of the cutting-cylinder pair 5. With respect to either the cutting knife mounting 23 and the groove beam 35, the circumferential elements 24 and 27 are arranged symmetrically relative thereto. To ensure easy accessibility of fastening screws 26 to the circumference of the cylinder cores 17 and 19, the respective covering 20, 21 does not extend continuously over the entire width of the two cylinders 16 and 18, but instead, annular interruptions are provided in the coverings 20 and 21, ensuring that the fastening screws 26 are easily accessible. Instead of the fastening screws 26, other standard parts can of course also be used for fastening the circumferential elements 24 and 27 to the respective cylinder cores 17 and 19.

The circumferential elements 24 and 27, which can be exchangeably mounted in pairs per cylinder core 17 and 19, respectively, may be made from an elastically deformable material; it would also be conceivable for them to be made from aluminum or an aluminum alloy. After removal of the circumferential elements 24 and 27 from the corresponding cylinder cores 17 and 19, the surfaces thereof can be reconditioned. Because this can occur outside the folder, the latter can go back into production after mounting a further, as yet unused, set of circumferential elements 24 and 27. The worn-out set of circumferential elements 24 and 27, respectively, can be reconditioned outside the machine until the circumferential elements 24 and 27 which are in use become worn out and themselves need exchanging in order to ensure cutting quality.

In addition to providing the cylinder cores 17 and 19, respectively, with the circumferential elements 24 and 27 according to FIG. 2, i.e., four circumferential elements 24 and 27, respectively, for each cylinder core 17, 19, it is likewise conceivable for cylinders of greater diameter to be provided with exchangeable circumferential elements 24 and 27. Although a cutting-cylinder pair 5 with cylinders of a single diameter is represented in FIG. 2, it is entirely possible for the invention also to be transferred to cylinders having a plurality of cutting knives or groove beams with approximately double or triple the diameter. The invention is suitable wherever a surface of cylinders exposed to wear has to be reconditioned without having to remove the entire cylinder from the printing press. Such cylinders may be sheet-guiding cylinders, storage drums, reversing or turning drums or else folding blade cylinders, jaw cylinders or the like in rotary printing presses and folders, respectively.

The circumferential elements 24 and 27, respectively, can also be fastened to the circumference of the cylinder cores 17 and 19 by register pins or other adjusting elements; the positions of the lay projections 29 and 31, respectively, arranged in the illustrated embodiment next to the cutting knife mounting 23 and the groove beam 35, respectively, may also be provided at other positions on the cylinder cores 17 and 19. Apart from the approximately square construction that is represented, it is also conceivable for the cylinder cores 17 and 19 themselves to have a triangular cross section, somewhat for receiving three circumferential elements on the circumference thereof, the outer surface of which then providing a continuous outer cylindrical or jacket surface. Stationary elements received on the circumference of a cylinder, such as the cutting knife mounting 23 or groove beam 35, for example, may similarly be integrated into the exchangeable circumferential elements 24 and 27, so that they are likewise exchangeable. In this manner, various cutting formats could be created by changing the cylinder geometry, just as different covering materials 20 and 21 on the circumferential surfaces 24 and 27 produce different cutting characteristics. Apart from the selection of the material with regard to Shore hardness and modulus of elasticity, the covering 20, 21 can also be modified with regard to the thickness of the covering. Thereby, the holding forces acting, before the cutting, upon the material webs 3 which are to be cut, can be set and adapted to the thickness of the material web 3.

We claim:

1. A device for cross cutting material webs having ends, the device comprising:

a cutting-cylinder pair formed of mutually cooperating cylinders, one of said cylinders having at least one cutting knife and the other of said cylinders having at least one groove beam, each of said cylinders having a substantially rectangular core, each of said cylinders having circumferential elements removably disposed on said rectangular core to form a circumferential core surface for taking up the end of a material web before a cross cutting operation, and said circumferential elements having at least one continuous covering to be engaged over said circumferential elements, said at least one covering having at least one end clamped between one of said circumferential elements and said substantially rectangular core.

2. The device according to claim 1, wherein said cylinder core of each of said cylinders has lay surfaces and lay projections.

3. The device according to claim 2, wherein one of said cylinders is a knife cylinder having a knife mounting, and said lay projections are arranged on said knife cylinder adjacent said knife mounting.

4. The device according to claim 2, wherein one of said cylinders is a groove cylinder having a groove beam, and said lay projections are arranged on said groove cylinder adjacent said groove beam.

5. The device according to claim 1, wherein said circumferential elements are formed of first circumferential elements and second circumferential elements, said first circumferential elements engaging over said second circumferential elements on said respective cylinder cores.

6. The device according to claim 1, wherein said first and said second circumferential elements, respectively, are provided separately with a continuous covering.

7. The device according to claim 1, wherein said circumferential elements are formed of an elastically deformable material.

8. The device according to claim 1, wherein said circumferential elements are formed of one of aluminum and an aluminum alloy.

9. A folder having a cutting-cylinder pair comprising:

a knife cylinder and a groove cylinder, each of said cylinders having a substantially rectangular core, at least one of said cylinders having circumferential elements removably disposed on said rectangular core to form a circumferential core surface for taking up an end of a material web before a cross cutting operation, and said circumferential elements having at least one continuous covering to be engaged over said circumferential elements, said at least one covering having at least one end clamped between one of said circumferential elements and said substantially rectangular core.

10. The folder according to claim 9, wherein the folder is of the pinless type.

* * * * *